US012385723B2

(12) United States Patent
Lv

(10) Patent No.: US 12,385,723 B2
(45) Date of Patent: Aug. 12, 2025

(54) THERMAL IMAGING TARGET

(71) Applicant: SHENZHEN GONGFENXIANG NETWORK TECHNOLOGY CO., LTD., Shenzhen (CN)

(72) Inventor: Liang Lv, Shenzhen (CN)

(73) Assignee: SHENZHEN GONGFENXIANG NETWORK TECHNOLOGY CO., LTD., Shenzhen (CN)

( * ) Notice: Subject to any disclaimer, the term of this patent is extended or adjusted under 35 U.S.C. 154(b) by 541 days.

(21) Appl. No.: 17/922,788

(22) PCT Filed: Nov. 24, 2021

(86) PCT No.: PCT/CN2021/132673

§ 371 (c)(1),
(2) Date: Nov. 2, 2022

(87) PCT Pub. No.: WO2022/199086

PCT Pub. Date: Sep. 29, 2022

(65) Prior Publication Data

US 2023/0160669 A1 May 25, 2023

(30) Foreign Application Priority Data

Mar. 24, 2021 (CN) ..... 202110314166.0

(51) Int. Cl.

| | |
|---|---|
| ***F41J 2/02*** | (2006.01) |
| ***F41J 1/01*** | (2006.01) |
| ***F41J 5/24*** | (2006.01) |

(52) U.S. Cl.

CPC .. *F41J 5/24* (2013.01); *F41J 1/01* (2013.01)

(58) Field of Classification Search

None

See application file for complete search history.

(56) References Cited

U.S. PATENT DOCUMENTS 5,319,213 A 6/1994 Watkins et al.
7,820,969 B2 * 10/2010 Guinn ..... F41J 2/02 250/504 R (Continued)

FOREIGN PATENT DOCUMENTS

CN 101625217 A 1/2010
CN 109523496 A 3/2019

(Continued)

OTHER PUBLICATIONS

Written Opinion of the International Searching Authority.
International Search Report for PCT/CN2021/132673.

*Primary Examiner* — Sunit Pandya

(57) ABSTRACT

A thermal imaging target includes a heating insulation layer, a heat conduction layer, a flow guiding layer, a bottom layer, and a self-heating package; the heat conduction layer bonded to the bottom layer, and an opening formed at the top to form a pocket-shaped structure; the self-heating package placed in a pocket, and a self-heating material arranged in the self-heating package for generating heat; the flow guiding layer placed between the heat conduction layer and the bottom layer to form cross-connected heat dissipation channels for guiding the heat generated by the self-heating package to crisscross flow in the pocket; the heat insulation layer attached to an outer surface of the heat conduction layer; thermal conductivity of the heat insulation layer lower than that of the heat conduction layer, so that a temperature difference is formed between the heat conduction layer and the heat insulation layer during heat conduction.

10 Claims, 5 Drawing Sheets

(56) References Cited

U.S. PATENT DOCUMENTS

| | | | | |
|---|---|---|---|---|
| 8,424,876 | B2 * | 4/2013 | Hutchinson | F41J 2/02 273/348.1 |
| 12,016,089 | B1 * | 6/2024 | Miele | F41J 1/10 |
| 2009/0194942 | A1 * | 8/2009 | Hodge | F41J 5/02 347/206 |
| 2011/0042900 | A1 | 2/2011 | Hutchinson et al. | |
| 2011/0175292 | A1 * | 7/2011 | Carni | F41J 2/02 273/348.1 |

FOREIGN PATENT DOCUMENTS

| | | | |
|---|---|---|---|
| CN | 212778891 | U | 3/2021 |
| CN | 113063321 | A | 7/2021 |
| RU | 189908 | U1 | 6/2019 |

* cited by examiner

THERMAL IMAGING TARGET

BACKGROUND

1. Technical Field

The present disclosure generally relates to the field of a target for shooting and aiming, and especially relates to a thermal imaging target suitable for shooting by a thermal imaging gun sight.

2. Description of Related Art

Gun sights, since its invention, had been widely used in sports, hunting and military activities for their accuracy to hit a target, and a target is an important tool for calibrating and checking the gun sight. The target is simple and easy to be used, low manufacturing costs, and alternated color rings on the target surface have standard diameters and sizes, which can accurately measure and indicate shooting results.

With the development of technology, a thermal imaging gun sight is becoming more popular in hunting and military activities because it can find and hit targets in dark environments; however, unlike other gun sights, the thermal imaging gun sights do not have a target that is convenient and economical to be used, because thermal imaging gun sights can't see color patterns or color rings of an ordinary target surface, it can only see temperature differences on the target surface. And because the ordinary target surface is made of the same material, there is almost no temperature difference between the pattern rings or color rings on the target surface, which is almost invisible by the thermal imaging gun sight, so that it is impossible to achieve functions of calibrating and checking the thermal imaging gun sight. In the related art, people realize calibration and inspection functions of the thermal imaging gun sight by accommodating themselves with materials at hand, such as electrically heating a target, using fire to heat small iron blocks to make a bullseye, or taping a crosshair pattern with an adhesive metal tape on a cardboard to make a thermal target and then placing the target under the sun to create a crosshair thermal pattern via a temperature difference between the metal tape and the cardboard. Although these above methods can be used, they are either not simple and easy to be used, or they are not economical and practical; or a shooter needs to walk a long distance to retriever the target materials, such as the electric heating and the iron blocks, for re-use after the shooting, or need repeated heating because the temperature of the target can't last a sufficient amount of time, let alone accurately measure and indicate shooting results thereof Therefore, the related art needs to be developed.

SUMMARY

The technical problems to be solved: in view of the shortcomings of the related art, the present disclosure provides a thermal imaging target which can have a temperature difference that lasts long enough to be clearly seen by a thermal imaging gun sight, and have advantages of a simplicity in a structure, convenience in use, a low manufacturing cost and worthwhile to be widely utilized.

The technical solution adopted for solving technical problems of the present disclosure is:

a thermal imaging target according to an embodiment of the present disclosure is configured for shooting and includes a heat insulation layer, a heat conduction layer, a flow guiding layer, a bottom layer, and a self-heating package;

the heat conduction layer hermetically connected to an edge of the bottom layer and including an opening formed at the top thereof to form a pocket-shaped structure which is called as a pocket;

the self-heating package placed in the pocket, and self-heating material arranged in the self-heating package and configured for generating heat;

the flow guiding layer placed between the heat conduction layer and the bottom layer in the pocket to form crisscross-connected heat dissipation channels therein for guiding the heat generated by the self-heating package to crisscross flow in the pocket;

the heat insulation layer attached to an outer surface of the heat conduction layer; and wherein a heat conductibility of the heat insulation layer is lower than that of the heat conduction layer, so that a temperature difference is formed between the heat conduction layer and the heat insulation layer during a heat conduction process.

Wherein the heat insulation layer is annular rings separated at intervals from each other, or in the shape of a person or an animal.

Wherein the flow guiding layer is a plurality of flow guiding posts staggered vertically in the pocket, and two ends of each of the plurality of flow guiding posts abut against the heat conduction layer and the bottom layer respectively.

Wherein the plurality of flow guiding posts props up the heat conduction layer and the bottom layer so that a gap of 1-4 mm is formed between the heat conduction layer and the bottom layer.

Wherein both the heat conduction layer and the bottom layer are square films or square sheets with matching dimensions therebetween.

Wherein the bottom layer includes an adhesive region at edges excluding the opening, and the heat conduction layer is adhered to the adhesive region of the bottom layer.

Wherein the heat conduction layer is a thermal conductive material.

Wherein the thermal insulation layer is a thermal insulation material.

Wherein the bottom layer is a thermal insulation material.

Wherein a surface color of the heat insulation layer is different from that of the heat conduction layer so that a color contrast is formed therebetween to be easily recognizable to human eyes.

The thermal imaging target of the present disclosure is designed with the simple structure which consists of the thermal insulation layer, the heat conduction layer, the flow guiding layer, the bottom layer and the self-heating package, it smartly uses a ready-made self-heating package as a heat source, which is commonly available and economically to be sued, and has no safety hazards because it generates heat fireless; furthermore, the heat generated by the self-heating package is kept inside the pocket-shaped structure that is formed by the heat conduction layer and the bottom layer, so as to be bigly used for heating up the heat conduction layer. The plurality of flow guiding posts of the flow guiding layer is arranged in a staggered mode to make hot air generated by the self-heating package to crisscross flow when the hot air rises in the pocket-shaped structure, so as to avoid a lower temperature area from forming above bullet holes of the target, thus ensuring a temperature evenly spread inside the pocket thereof. In addition, the heat insulation layer is attached to the outer surface of the heat conduction layer, and the heat conductibility of the heat insulation layer is lower than that of the heat conduction layer, so that the temperature difference is formed between the heat conduction layer and the heat insulation layer during the heat conduction process when the heat is generated by the self-heating package. The heat insulation layer is designed into annular rings which are spaced at intervals, it generates the temperature difference at a surface of the target to form ring-shaped patterns which can be detected by the thermal imaging gun sights.

The thermal imaging target of the present disclosure can be rapidly deployed, is simple and easy to be used, has a simple structure and a low manufacturing cost, which is economical and practical, and the surface of the target can generate sufficient temperature differences to be detected by the thermal imaging gun sight as a certain thermal pattern; while the temperature difference can last long enough for shooting, the rings on the surface of the target have standard diameters and sizes to achieve accurate calibration and inspection; at the same time, the color contrast exists between the rings on the surface of the target suitable for being used with ordinary gun sights, which greatly improves convenience of calibration and inspection of the thermal imaging gun sight.

Figure 1:
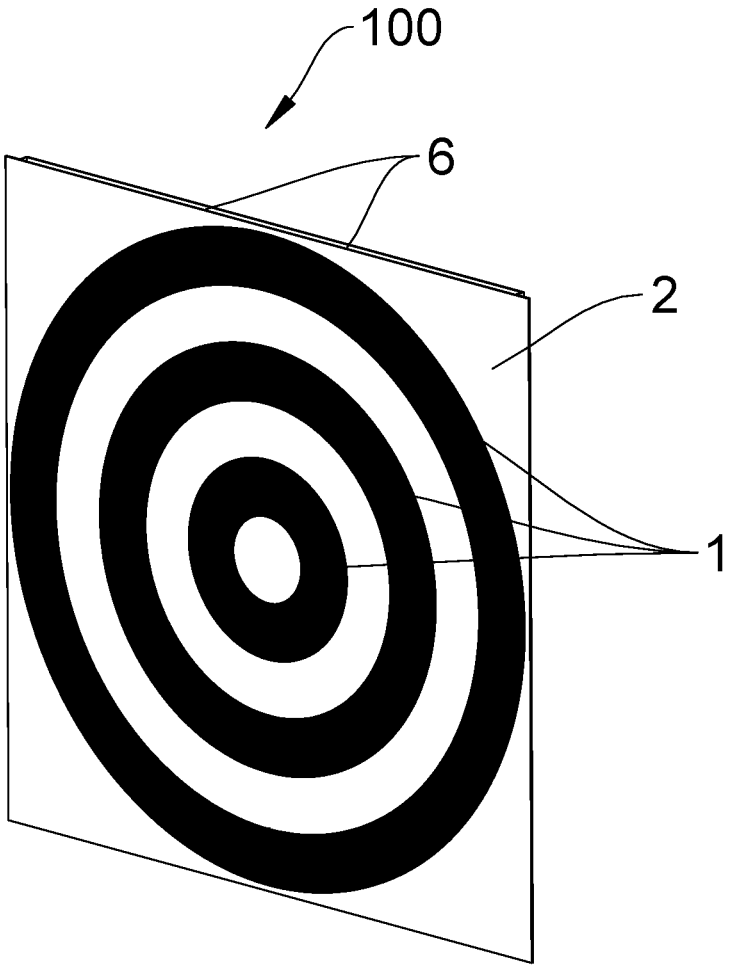
FIG. 1 is a schematic view of a thermal imaging target in accordance with an embodiment of the present disclosure.

The element labels according to the exemplary embodiment of the present disclosure shown as below:

100 thermal imaging target, 1 heat insulation layer, 11 annular ring, 2 heat conduction layer, 3 flow guiding layer, 31 flow guiding post, 4 bottom layer, 41 adhesive region, 5 self-heating package, 6 opening, 7 heat dissipation channel, 8 pocket-shaped structure.

DETAILED DESCRIPTION

Reference will now be made in detail to embodiments, examples of which are illustrated in the accompanying drawings. The same or similar reference numerals throughout indicate the same or similar elements or elements with the same or similar functions. The embodiments described below with reference to the accompanying drawings are illustrative and intended to be used to explain the present disclosure, rather than being construed as a limitation of the present disclosure.

Figure 2:
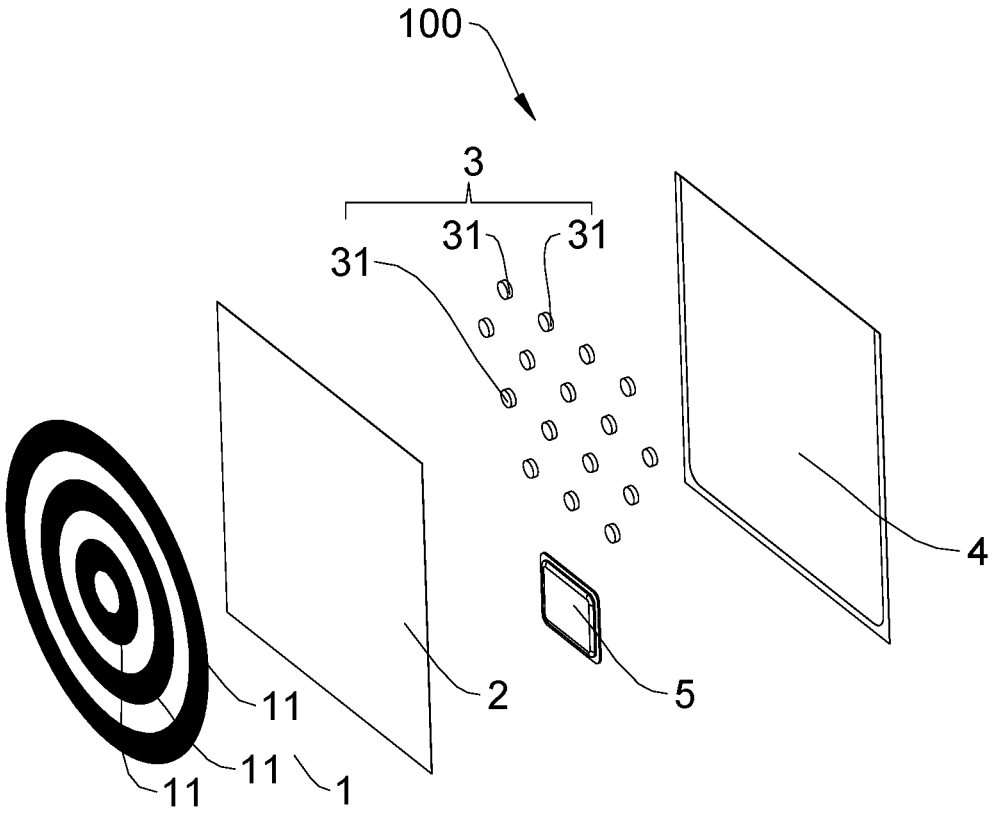
FIG. 2 is an exploded, schematic view of the thermal imaging target of FIG. 1.

Referring to FIG. 1 and FIG. 2, a thermal imaging target 100 according to an embodiment of the present disclosure is provided for shooting and training. The thermal imaging target 100 includes a heat insulation layer 1, a heat conduction layer 2, a flow guiding layer 3, a bottom layer 4 and a self-heating package 5.

Figure 3:
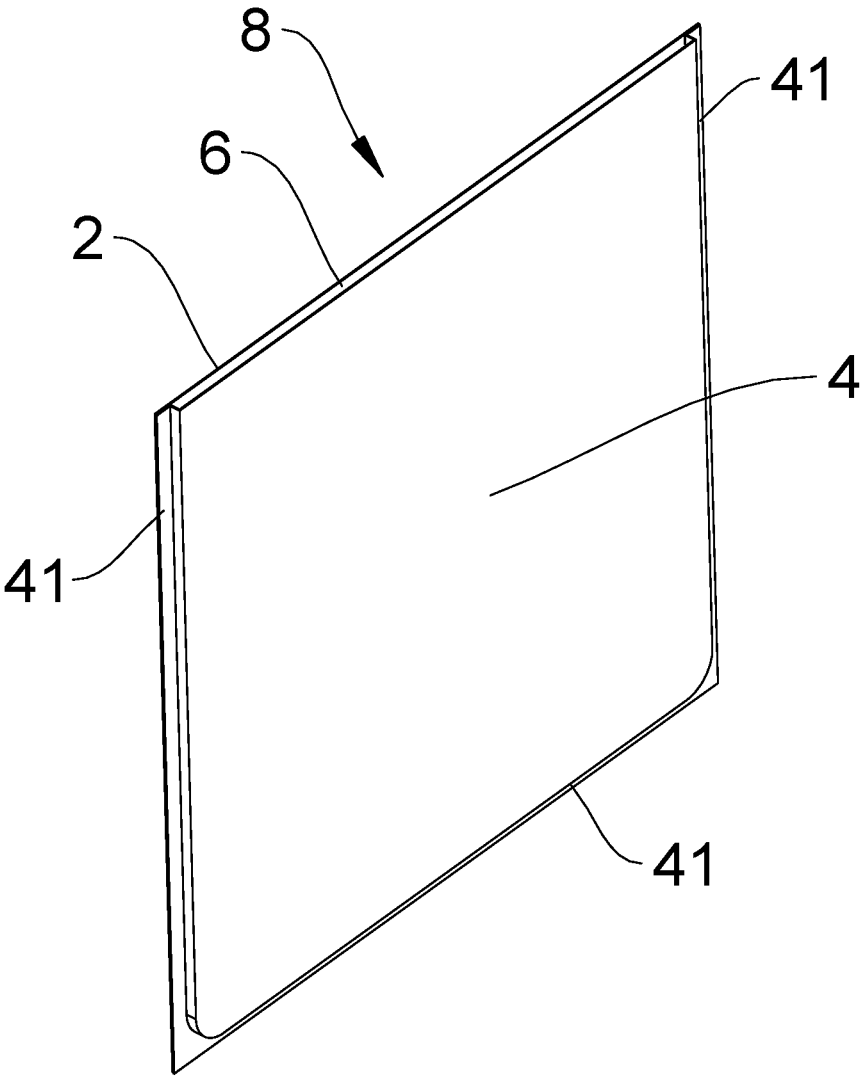
FIG. 3 is a schematic view of a pocket-shaped structure formed by a heat-conduction layer and a bottom layer of the thermal imaging target of FIG. 1.

Referring to FIG. 3, the heat conduction layer 2 of the present disclosure is hermetically connected to edges of the bottom layer 4 and includes an opening 6 at a top end thereof to form a pocket-shaped structure 8. The heat conduction layer 2 and the edges of the bottom layer 4 can be sealed by glue or heat melting. The pocket-shaped structure 8 formed by the heat conduction layer 2 and the bottom layer 4 is configured to receive the self-heating package 5 therein and keeps the heat generated by the self-heating package 5 inside the pocket; at the same time, the opening 6 at the top end of the pocket-shaped structure 8 is configured for exhausting the air that is heat expanded in the pocket, so as to prevent the pocket from bursting due to an excessive pressure in the pocket.

Preferably, both the heat conduction layer 2 and the bottom layer 4 of the thermal imaging target 100 of the present disclosure are square films or square sheets with matching dimensions therebetween. That is, the heat conduction layer 2 and the bottom layer 4 are matched in the size and the shape, and are in a square film or a square sheet, which is easy to obtain or process.

Figure 5:
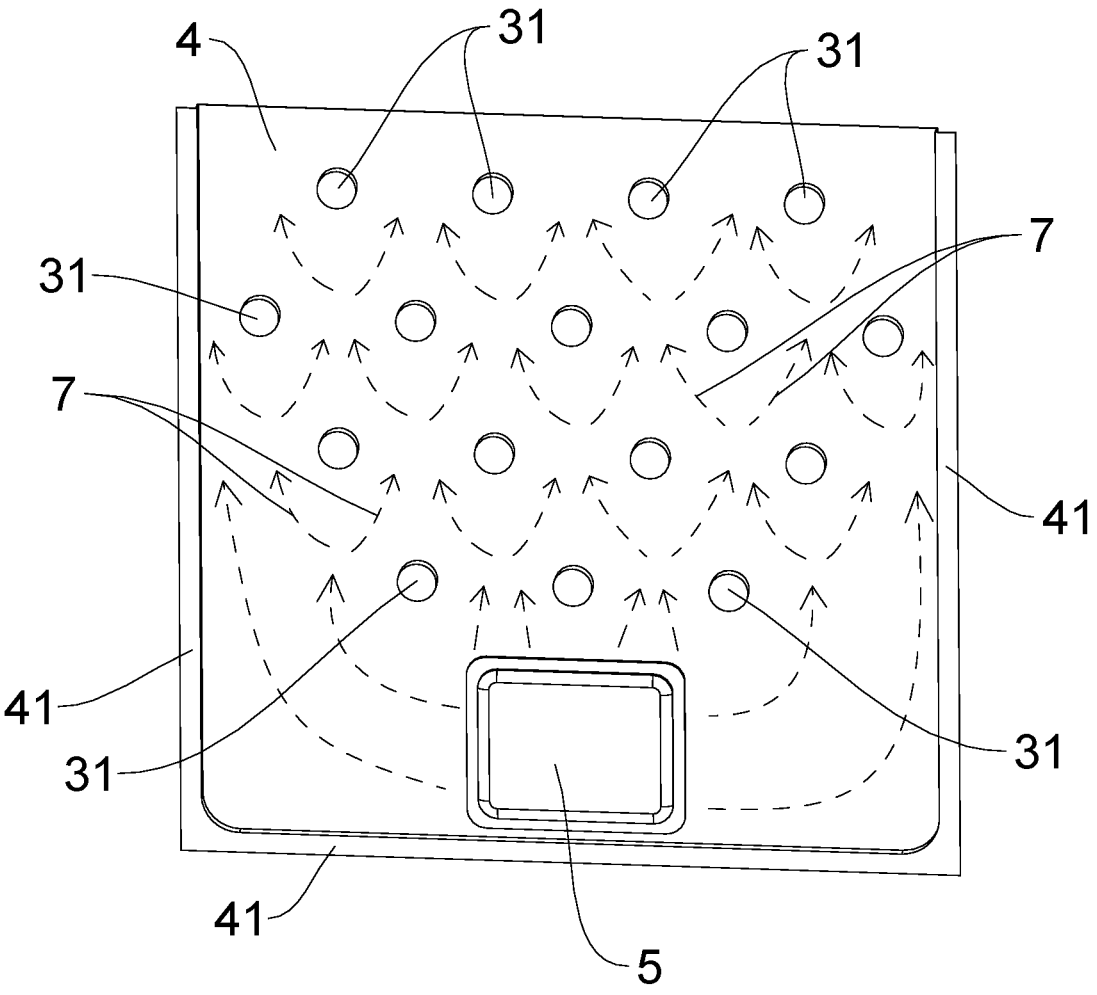
FIG. 5 is a schematic view of an air flow guided by a flow guiding layer of the present disclosure.

Furthermore, referring to FIG. 3 and FIG. 5, the bottom layer 4 of the thermal imaging target 100 of the present disclosure includes an adhesive region 41 at the edges excluding the opening 6, and the heat conduction layer 2 is adhered to the adhesive region 41 of the bottom layer 4. The adhesive region 41 is provided to conveniently bond the heat conduction layer 2 with the bottom layer 4.

Figure 4:
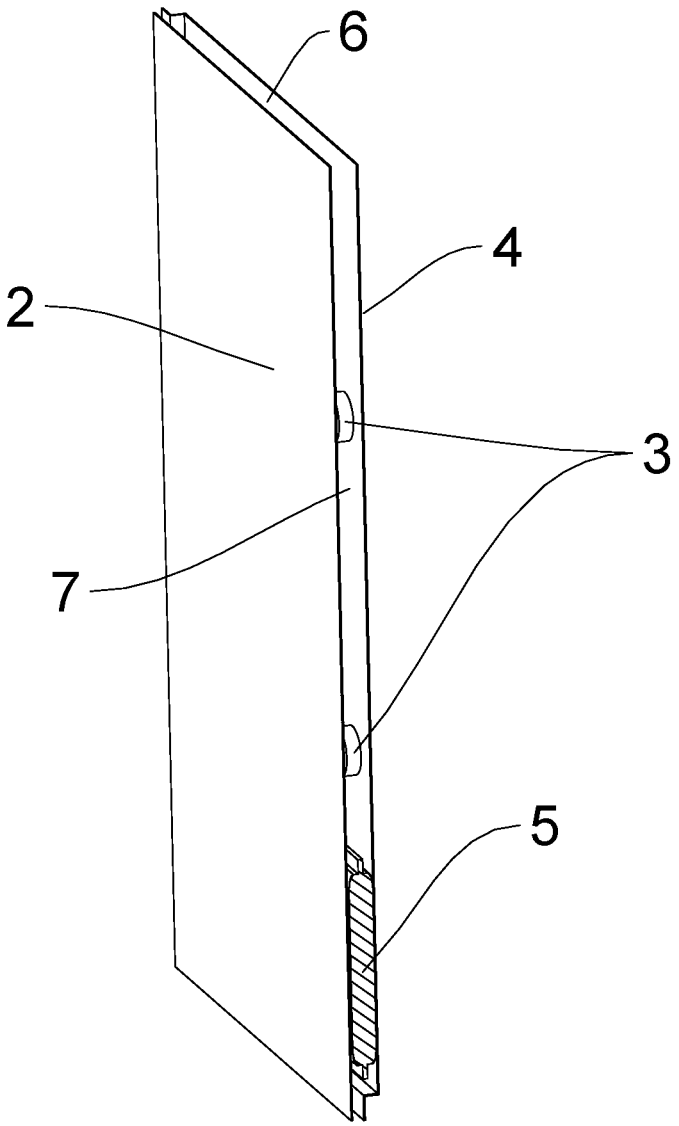
FIG. 4 is a crisscross-sectional view of FIG. 3.

Referring to FIG. 4, the self-heating package 5 of the thermal imaging target 100 of the present disclosure is placed in the pocket, and self-heating material is arranged in the self-heating package 5 to generate heat. The heat generated by the self-heating package 5 is configured to heat up the heat conduction layer 2.

The self-heating package 5 of the present disclosure directly uses a conventional food self-heating package as a heating source, which is convenient and economical, and has no potential safety hazards because the food self-heating package generates heat fireless.

The self-heating package 5 is made of a self-heating material, which is also called fireless heating, and generates a big amount of heat through a chemical reaction between the self-heating material and water or oxygen in the air; for example, magnesium powder is a main component of the self-heating material of the most commonly used self-heating food at present, the heat is generated by the chemical reaction between the magnesium powder with the water, and a chemical formula thereof is $Mg+2H_2O=Mg(OH)_2+H_2[+$ heat (q)], which is widely used in the self-heating food industry.

Referring to FIG. 5, the flow guiding layer 3 of the thermal imaging target 100 of the present disclosure props up the heat conduction layer 2 and the bottom layer 4 that are received in the pocket, to form crisscross-connected heat dissipation channels 7 between the heat conduction layer 2 and the bottom layer 4 for guiding the heat generated by the self-heating package 5 to flow crisscross in the pocket.

The flow guiding layer 3 is placed between the heat conduction layer 2 and the bottom layer 4 to form the heat dissipation channels 7 between the heat conduction layer 2 and the bottom layer 4, so that a certain gap is kept between the heat conduction layer 2 and the bottom layer 4, thereby hot air heated up by the self-heating package 5 can conveniently flow between the heat conduction layer 2 and the bottom layer 4; at the same time, the heat dissipation channels 7 are set in a crisscross-connected configuration, the hot air can flow in the pocket-shaped structure 8 in a crisscross pattern, even if the pocket-shaped structure 8 is penetrated by a bullet, hot air circulation is still occurred in an area above the bullet hole at the pocket-shaped structure 8, thereby a lower temperature area above the bullet hole can be avoided, so as to keep the target remain its thermal function after being repeatedly shoot at.

Referring to FIG. 1 and FIG. 2, The heat insulation layer 1 of the thermal imaging target 100 of the present disclosure is attached on an outer surface of the heat conduction layer 2, and the thermal conductivity of the heat insulation layer 1 is lower than that of the heat conduction layer 2, so that a temperature difference is formed between the heat insulation layer 1 and the heat conduction layer 2 during a heat conduction process.

Preferably, the heat conduction layer 2 of the present disclosure is a heat conduction material with good heat conductibility, such as a heat conduction plastic film or a metal foil, and the heat insulation layer 1 of the present disclosure is a heat insulation material, such as heat insulation plastic with a poor heat conductibility. In this way, the heat generated by the self-heating package 5 can be quickly conducted on the surface of the heat conduction layer 2, due to the heat insulation effect of the heat insulation layer 1, a temperature of the outer surface of the heat insulation layer 1 and a temperature of the surface of the heat conduction layer 2 are different, so that when a thermal imaging gun sight is used for observation, a temperature difference formed between a region where the heat insulation layer 1 is not attached to the heat conduction layer 2, and a region where the heat insulation layer 1 is attached to the heat conduction layer 2, can be detected by the thermal imaging gun sights.

In an embodiment of the present disclosure, the heat insulation layer 1 of the thermal imaging target 100 of the present disclosure is annular rings 11 separated at intervals from each other. The annular rings 11 separated at intervals enable that a standard target ring pattern can be detected when the thermal imaging target 100 of the present disclosure is viewed by the thermal imaging gun sights.

When the thermal imaging target 100 of the present disclosure is used, the hot air that is generated by the self-heating package 5 is separated by the flow guiding layer 3 to crisscross flow in pocket-shaped structure 8 when the hot air rises in the pocket-shaped structure 8; meanwhile, the temperature of the heat conduction layer 2 evenly rises due to the good heat conductibility of the heat conduction layer 2, and the heat insulation layer 1 is adhered to the heat conduction layer 2 and the heat conductibility of the heat insulation layer 1 is very different from that of the heat conduction layer 2, so that spaced at intervals annular regions with a big temperature contrast are formed by the heat insulation layer 1 consisting of the plurality of annular rings 11 spaced at intervals from each other, and the heat conduction layer 2 behind the heat insulation layer 1. The thermal imaging gun sight is configured to sense the temperature difference of the environment, these annular regions with the big temperature contrast formed by the heat insulation layer 1 and the heat conductive layer 2, and separated at interval from each other, can be detected by the thermal imaging gun sight just like the ring of the ordinary target surface.

At the same time, the pocket-shaped structure 8 formed by the heat conduction layer 2 and the bottom layer 4 can keep and spread the heat generated by the self-heating package 5 as evenly as possible in the pocket-shaped structure 8 so that the heat can be used to heat the heat conduction layer 2. A small amount of heat can generate a sufficient temperature difference between the spaced at intervals rings formed by the heat insulation layer 1 and the heat conduction layer 2 on the target surface so that it can be detected by the thermal imaging gun sights, and a conventional self-heating package can keep the thermal imaging target of the present disclosure functional for 30 to 90 minutes, so that the thermal imaging target 100 can remain active for a good duration of time to be used for shooting.

Preferably, the bottom layer 4 of the thermal imaging target 100 of the present disclosure is also made of the thermal insulation material, such as thermal insulating plastic, which can keep the heat inside the pocket as much as possible and prolong a usable time of the thermal imaging target.

Specifically, referring to FIG. 2, the flow guiding layer 3 of the thermal imaging target 100 of the present disclosure is a plurality of flow guiding posts 31 arranged in the pocket-shaped structure 8 that is called as a pocket, and staggered vertically in the pocket, and two ends of each of the plurality of flow guiding posts 31 abut against the heat conduction layer 2 and the bottom layer 4, respectively. Referring to FIG. 5, the plurality of flow guiding posts 31 arranged in a staggered mode from top to bottom, divide a cavity in the pocket into heat dissipation channels 7 that are cross-connected with each other. The two ends of the flow guiding post 31 can be adhered to the heat conduction layer 2 and the bottom layer 4 by glue or heat melting.

That is, the plurality of flow guiding posts 31 of the present disclosure arranged in a staggered arrangement extends from the top of the self-heating package 5 to the opening 6 of the pocket. The heat generated by the heat self-heating package 5 is crisscross scattered by the plurality of flow guiding posts 31, so that the heat is prevented from rising vertically; in this way, when the thermal imaging target 100 is penetrated by a bullet, the hot air in the heat dissipation channels 7 that are cross-connected can flow into the space above the bullet hole in the pocket-shaped structure 8, so that the heat above the bullet hole can be evenly distributed, so as to avoid a lower temperature area from forming above a bullet hole, and functionality of the thermal imaging target can be kept.

Preferably, the plurality of flow guiding posts 31 of the present disclosure props up the heat conduction layer 2 and the bottom layer 4 so that a gap of 1-4 mm is formed between the heat conduction layer 2 and the bottom layer 4. The gap of 1-4 mm is provided to make the heat conduction more efficient.

It can be understood that a shape of the thermal insulation layer 1 of the thermal imaging target 100 of the present disclosure is not necessarily limited to be the annular rings 11 that are separated at intervals from each other, but can also be made into the shape of a person or an animal according to actual requirements.

Furthermore, a surface color of the heat insulation layer 1 is different from that of the heat conduction layer 2 so that a color contrast is formed therebetween to be easily recognizable to human eyes. Although the color contrast between the heat insulation layer 1 and the heat conduction layer 2 can't be seen by the thermal imaging gun sight, it can be used by ordinary gun sights or configured to quickly read the ring-number. That is to say, the thermal imaging target 100 of the present disclosure can be used as shooting targets by ordinary gun sights.

When the thermal imaging target 100 of the present disclosure is used, the seal of the self-heating package 5 is torn off, and if the self-heating package 5 reacts with water, a certain amount of water is put through the opening 6 into the pocket-shaped structure 8, the hot air generated by the self-heating package 5 is separated by the flow guiding layer 3 to crisscross flow in pocket-shaped structure 8 when the hot air rises in the pocket-shaped structure 8; meanwhile, the temperature of the heat conduction layer 2 evenly rises due to the good heat conductibility of the heat conduction layer 2, and the heat insulation layer 1 is adhered to the heat conduction layer 2 and the heat conductibility of the heat insulation layer 1 is very different from that of the heat conduction layer 2, so that spaced at intervals annular regions with the big temperature contrast are formed by the heat insulation layer 1 consisting of the plurality of annular rings 11 that are spaced at intervals, and the heat conduction layer 2 behind the heat insulation layer 1. The annular regions with the big temperature contrast formed by the heat insulation layer 1 and the heat conductive layer 2, and separated at intervals with each other, can be detected by the thermal imaging gun sight just like the ring of the ordinary target surface, there is a sufficient temperature difference last long enough between the annular rings on the target surface to be clearly visible by the thermal imaging gun sight.

In summary, the thermal imaging target 100 of the present disclosure overcomes disadvantages of the related art by smartly using the ready-made food self-heating package 5 as the heat source, which is commonly available and economically to be used, and has no safety hazard because it is heated fireless; the heat generated by the self-heating package 5 is kept in the pocket-shaped structure 8 that is formed by the heat conduction layer 2 and the bottom layer 4, so as to be largely used for heating up the heat conduction layer 2. The plurality of flow guiding posts 31 of the flow guiding layer 3 is arranged in a staggered mode to make the hot air generated by the self-heating package 5 flow crisscross when the hot air rises in the pocket-shaped structure 8, so as to avoid a lower temperature area from forming above bullet holes of the target, thus ensuring the temperature evenly spread inside the pocket thereof. In addition, the annular regions which are spaced at intervals and formed by the heat insulation layer 1 and the heat conduction layer 2 are designed to generate target rings that have the temperature difference and can be detected by the thermal imaging gun sight.

The thermal imaging target 100 of the present disclosure can be rapidly deployed, is simple and easy to be used, has a simple structure and a low manufacturing cost, which is economical and practical, and the surface of the target can generate sufficient temperature differences to be detected by the thermal imaging gun sight as a certain thermal pattern; while the temperature difference can last long enough for shooting, the rings on the target surface have standard diameters and sizes to achieve accurate calibration and inspection; at the same time, the color contrast exists between the rings on the target surface suitable for being used with ordinary gun sights, which greatly improves convenience of calibration and inspection of the thermal imaging gun sight.

Although the features and elements of the present disclosure are described as embodiments above, it can be understood that the above embodiments are illustrative and intended to be used to explain the present disclosure, rather than being construed as a limitation of the present disclosure. Any variation or replacement made by one of ordinary skill in the related art without departing from the spirit of the present disclosure shall fall within the protection scope of the present disclosure.

What is claimed is:

1. A thermal imaging target configured for shooting and comprising a heat insulation layer, a heat conduction layer, a flow guiding layer, a bottom layer and a self-heating package;

the heat conduction layer hermetically connected to edges of the bottom layer and comprising an opening formed at the top thereof to form a pocket-shaped structure which is called as a pocket thereof;

the self-heating package placed in the pocket, and self-heating material arranged in the self-heating package and configured for generating heat;

the flow guiding layer placed between the heat conduction layer and the bottom layer in the pocket to form crisscross-connected heat dissipation channels therein for guiding the heat generated by the self-heating package to crisscross flow in the pocket;

the heat insulation layer attached to an outer surface of the heat conduction layer; and wherein heat conductibility of the heat insulation layer is lower than that of the heat conduction layer, so that a temperature difference is formed between the heat conduction layer and the heat insulation layer during a heat conduction process.

2. The thermal imaging target as claimed in claim 1, wherein the heat insulation layer is annular rings separated at intervals from each other, or in the shape of a person or an animal.

3. The thermal imaging target as claimed in claim 1, wherein the flow guiding layer is a plurality of flow guiding posts staggered vertically in the pocket, and two ends of each of the plurality of flow guiding posts abut against the heat conduction layer and the bottom layer respectively.

4. The thermal imaging target as claimed in claim 3, wherein the plurality of flow guiding posts props up the heat conduction layer and the bottom layer so that a gap of 1-4 mm is formed between the heat conduction layer and the bottom layer.

5. The thermal imaging target as claimed in claim 1, wherein both the heat conduction layer and the bottom layer are square films or square sheets with matching dimensions therebetween.

6. The thermal imaging target as claimed in claim 1, wherein the bottom layer comprises an adhesive region at edges excluding the opening, and the heat conduction layer is adhered to the adhesive region of the bottom layer.

7. The thermal imaging target as claimed in claim 1, wherein the heat conduction layer is a thermal conductive material.

8. The thermal imaging target as claimed in claim 1, wherein the thermal insulation layer is a thermal insulation material.

9. The thermal imaging target as claimed in claim 1, wherein the bottom layer is a thermal insulation material.

10. The thermal imaging target as claimed in claim 1, wherein a surface color of the heat insulation layer is different from that of the heat conduction layer so that a color contrast is formed therebetween to be easily recognizable to human eyes.

* * * * *